US009067327B2

(12) United States Patent
Li et al.

(10) Patent No.: US 9,067,327 B2
(45) Date of Patent: Jun. 30, 2015

(54) CUTTING DEVICE AND CUTTING METHOD OF A LIQUID CRYSTAL PANEL

(75) Inventors: Dong Li, Shenzhen (CN); Feng She, Shenzhen (CN); Cheng-ming Huang, Shenzhen (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 397 days.

(21) Appl. No.: 13/379,021

(22) PCT Filed: Nov. 30, 2011

(86) PCT No.: PCT/CN2011/083201

§ 371 (c)(1), (2), (4) Date: Dec. 18, 2011

(87) PCT Pub. No.: WO2013/078632

PCT Pub. Date: Jun. 6, 2013

(65) Prior Publication Data

US 2013/0133491 A1 May 30, 2013

(51) Int. Cl.

| | |
|---|---|
| ***B26D 1/11*** | (2006.01) |
| ***B26D 5/08*** | (2006.01) |
| ***B26D 7/20*** | (2006.01) |

(52) U.S. Cl.

CPC ..... *B26D 1/11* (2013.01); *B26D 5/086* (2013.01); *B26D 7/20* (2013.01)

(58) Field of Classification Search

USPC ..... 83/39, 72, 648, 169, 98, 879, 883, 884, 83/886

See application file for complete search history.

(56) References Cited

U.S. PATENT DOCUMENTS

| | | | | |
|---|---|---|---|---|
| 6,386,084 | B1 * | 5/2002 | Kato | 83/880 |
| 7,770,500 | B2 * | 8/2010 | Nishio et al. | 83/435 |
| 8,011,546 | B2 * | 9/2011 | Ueyama et al. | 225/96 |
| 8,104,385 | B2 * | 1/2012 | Hayashi et al. | 83/15 |
| 8,113,401 | B2 * | 2/2012 | Choo et al. | 225/96.5 |
| 2005/0229755 | A1 | 10/2005 | Okajima | |
| 2010/0011927 | A1 | 1/2010 | Lee | |
| 2010/0258605 | A1 | 10/2010 | Choo et al. | |

FOREIGN PATENT DOCUMENTS

| | | | |
|---|---|---|---|
| CN | 1678439 | A | 10/2005 |
| CN | 1265947 | C | 7/2006 |
| CN | 101565270 | A | 10/2009 |
| CN | 201473449 | U | 5/2010 |
| JP | 5105465 | A | 4/1993 |
| JP | 2007045642 | A | 2/2007 |
| KR | 20060072556 | A | 6/2006 |

* cited by examiner

*Primary Examiner* — Omar Flores Sanchez

(57) ABSTRACT

A cutting device and a cutting method of a liquid crystal panel are provided. The liquid crystal panel includes a first substrate and a second substrate assembled together. The cutting device of the liquid crystal panel includes a first cutting portion for cutting the first substrate and a second cutting portion for cutting the second substrate. The second cutting portion includes a support portion. The support portion is used to support the first substrate when the first cutting portion cuts the first substrate and the second cutting portion does not cut the second substrate yet. The present invention assures the cutting quality, improves the cutting efficiency and reduces the cutting cost.

13 Claims, 5 Drawing Sheets

CUTTING DEVICE AND CUTTING METHOD OF A LIQUID CRYSTAL PANEL

BACKGROUND OF THE INVENTION

1. Field of the Invention

The present invention relates to a manufacturing technology field of liquid crystal panel, and more particularly to a cutting device and a cutting method of a liquid crystal panel.

2. Description of the Prior Art

With the popularity of a liquid crystal display, the demand for the manufacture efficiency of the liquid crystal panel becomes more and more high.

In the process of manufacturing the liquid crystal panel, after a TFT (Thin Film Transistor) substrate is combined with a CF (Color Filter) substrate, two ends of the CF substrate need to be cut out for exposing metal wires disposed on two ends of the TFT substrate. Therefore the length or the width of the TFT substrate is not identical with that of the CF substrate, thereby forming a terminal portion.

Please refer to FIG. 1A, a liquid crystal panel 10' comprises a TFT substrate 11' and a CF substrate 12'. Wherein a terminal portion 111' formed on two ends of the TFT substrate 11' includes multiple metal wires 1111', and these metal wires 1111' are arranged along a direction B.

Please refer to FIG. 1B, the cutting device comprises an upper cutter head 21' and a lower cutter head 22'. When the cutter device cuts the liquid crystal panel 10' shown by FIG. 1A, if a cutting direction L (namely a flow direction of the liquid crystal panel 10') of the cutting device is perpendicular to the arrangement direction B of the metal wires 1111', the cutting device needs to pass through the terminal portion 111' in the course of cutting the liquid crystal panel 10'. Now two things will appear:

First, if the upper cutter head 21' starts to cut the TFT substrate 11', and the lower cutter head 22' simultaneously starts to cut the CF substrate 12', the distance between the upper cutter head 21' and the lower cutter head 22' along the cutting direction L is too large to result in the break of the liquid crystal panel.

Second, if the distance between the upper cutter head 21' and the lower cutter head 22' along the cutting direction L is over small, when the upper cutter head 21' cuts the TFT substrate 11', the lower cutter head 22' also cuts the TFT substrate 11'. So when the lower cutter head 22' moves to the CF substrate 12', it will bump one side edge of the CF substrate 12'. This results that the liquid crystal panel 10' abnormally moves or the lower cutter head 22' stops going ahead at the side edge of the CF substrate 12', so that largely affecting the cutting quality.

In order to avoid above adverse effect produced in the course of cutting the liquid crystal panel 10' because the cutting direction L of the cutting device is perpendicular to the arrangement direction B of the metal wires 1111', the prior art generally adopts the following two ways to cut out the terminal portion 111'.

First, please refer to FIG. 1C, the arrangement direction B of the metal wires 1111' of the liquid crystal panel 10' is controlled to be parallel to the cutting direction L of the cutting device, so that the prior cutting device can cut out the terminal portion 111' of the liquid crystal panel 10'. But according to this way, if the arrangement direction B of the metal wires 1111' is not parallel to the cutting direction L of the cutting device, which needs to readjust the flow direction of the liquid crystal panel 10'. This will result in increasing the manufacture time of the single product and reducing the manufacture efficiency.

Second, the cutting device is provided with a pre-cutting portion. The pre-cutting portion is used to cut out the terminal portion 111' of the liquid crystal panel 10' in advance, so that making the length and the width of the TFT substrate 11' be identical to those of the CF substrate 12'. And then the prior cutting device cuts the liquid crystal panel 10'. However, it needs to add a pre-cutting portion to the prior cutting device, so that making the process be complex and increasing the manufacture cost.

In conclusion, when cutting the liquid crystal panel in the prior art, because the TFT substrate has a terminal portion, it can result in the flow direction of the liquid crystal panel being limited or the cutting process being complex and has a high cost. Hence, this is one of the technology problems needed to be solved in the manufacturing technology field of the liquid crystal panel.

BRIEF SUMMARY OF THE INVENTION

One object of the present invention is to provide a cutting device of a liquid crystal panel to solve the problems that when cutting the liquid crystal panel, the flow direction of the liquid crystal panel is limited or the cutting process is complex and has a high cost because two ends of a TFT substrate has a terminal portion in the prior art.

For solving above problems, the present invention adopts a cutting device of a liquid crystal panel. The liquid crystal panel comprises a first substrate and a second substrate assembled together. The cutting device of the liquid crystal panel comprises a first cutting portion and a second cutting portion. The first cutting portion includes a first cutter head for cutting the first substrate. The second cutting portion includes a second cutter head for cutting the second substrate. The first cutter head and the second cutter head are staggered in a direction perpendicular to the liquid crystal panel, and the first cutter head and the second cutter head are spaced a distance in a direction parallel to the liquid crystal panel. The second cutting portion further includes a support portion. The support portion is a nozzle. The nozzle is used to eject gas for supporting the first substrate when the first cutting portion cuts the first substrate and the second cutting portion does not cut the second substrate yet.

In the cutting device of the liquid crystal panel of the present invention, the second cutter head and the second substrate are spaced a cutter-feeding distance along the direction perpendicular to the liquid crystal panel.

In the cutting device of the liquid crystal panel of the present invention, the second cutting portion further includes a second base and a second bracket. The second bracket and the support portion are disposed on the second base. A distance between the second bracket and the first substrate is less than a distance between the support portion and the first substrate.

In the cutting device of the liquid crystal panel of the present invention, the first cutting portion includes the first cutter head, a first bracket, a first base, a first motor and a first screw rod. The first cutter head is disposed on the first bracket, the first bracket is disposed on the first base, the first motor is connected to the first base, the first base is slidably connected to the first screw rod, and the first motor is used to drive the first base to slide along the first screw rod. The second cutting portion includes the second cutter head, a second bracket, a second base, a second motor, a second screw rod and the support portion. The second motor is connected to the second base, the second base is slidably connected to the second screw rod, and the second motor is used to drive the second base to slide along the second screw rod.

In the cutting device of the liquid crystal panel of the present invention, the distance between the first cutter head and the second cutter head along the direction parallel to the liquid crystal panel is less than or equal to 3.5 millimeter.

Another object of the present invention is to provide a cutting device of a liquid crystal panel to solve the problems that when cutting the liquid crystal panel, the flow direction of the liquid crystal panel is limited or the cutting process is complex and has a high cost because two ends of a TFT substrate has a terminal portion in the prior art.

For solving above problems, the present invention adopts a cutting device of a liquid crystal panel. The liquid crystal panel comprises a first substrate and a second substrate assembled together. The cutting device of the liquid crystal panel comprises a first cutting portion used to cut the first substrate and a second cutting portion used to cut the second substrate. The second cutting portion includes a support portion. The support portion is used to support the first substrate when the first cutting portion cuts the first substrate and the second cutting portion does not cut the second substrate yet.

In the cutting device of the liquid crystal panel of the present invention, the first cutting portion includes a first cutter head for cutting the first substrate, and the second cutting portion includes a second cutter head for cutting the second substrate. The first cutter head and the second cutter head are staggered in a direction perpendicular to the liquid crystal panel, and the first cutter head and the second cutter head are spaced a distance in a direction parallel to the liquid crystal panel.

In the cutting device of the liquid crystal panel of the present invention, the second cutter head and the second substrate are spaced a cutter-feeding distance along the direction perpendicular to the liquid crystal panel.

In the cutting device of the liquid crystal panel of the present invention, the second cutting portion further includes a second base and a second bracket. The second bracket and the support portion are disposed on the second base. A distance between the second bracket and the first substrate is less than a distance between the support portion and the first substrate.

In the cutting device of the liquid crystal panel of the present invention, the first cutting portion includes the first cutter head, a first bracket, a first base, a first motor and a first screw rod. The first cutter head is disposed on the first bracket, the first bracket is disposed on the first base, the first motor is connected to the first base, the first base is slidably connected to the first screw rod, and the first motor is used to drive the first base to slide along the first screw rod. The second cutting portion includes the second cutter head, a second bracket, a second base, a second motor, a second screw rod and the support portion. The second motor is connected to the second base, the second base is slidably connected to the second screw rod, and the second motor is used to drive the second base to slide along the second screw rod.

In the cutting device of the liquid crystal panel of the present invention, the distance between the first cutter head and the second cutter head along the direction parallel to the liquid crystal panel is less than or equal to 3.5 millimeter.

In the cutting device of the liquid crystal panel of the present invention, the support portion is a nozzle. The nozzle is used to eject gas for supporting the first substrate.

Another object of the present invention is to provide a cutting method of a liquid crystal panel to solve the problems that when cutting the liquid crystal panel, the flow direction of the liquid crystal panel is limited or the cutting process is complex and has a high cost because two ends of a TFT substrate has a terminal portion in the prior art.

For solving above problems, the present invention adopts a cutting method of a liquid crystal panel. The liquid crystal panel comprises a first substrate and a second substrate assembled together. The cutting method of the liquid crystal panel comprises the following steps:

providing a cutting device of the liquid crystal panel, the cutting device of the liquid crystal panel comprising a first cutting portion and a second cutting portion, the second cutting portion including a support portion;

controlling the first cutting portion to contact the first substrate and start to cut the first substrate, and simultaneously employing the support portion to support the first substrate;

controlling the second cutting portion to contact the second substrate and start to cut the second substrate, and stopping the support portion supporting the first substrate.

In the cutting method of the liquid crystal panel, before controlling the second cutting portion to contact the second substrate, the method further comprises the following step: controlling the second cutting portion to move a cutter-feeding distance along a direction perpendicular to the liquid crystal panel for contacting the second substrate.

In the cutting method of the liquid crystal panel, the support portion is a nozzle. The step of employing the support portion to support the first substrate includes: employing the nozzle to eject gas for supporting the first substrate.

Comparing with the prior art, the present invention disposes the support portion, such as the nozzle. When the first cutting portion cuts the first substrate and the second cutting portion does not cut the second substrate yet, the support portion can support the first substrate. Obviously, regardless of the flow direction of the liquid crystal panel having the terminal portion, the present invention can efficiently cut the liquid crystal panel, eliminate the adverse effect produced by the terminal portion when cutting the liquid crystal panel, assure the cutting quality, and improve the cutting efficiency. There is no need to add a pre-cutting portion and can reduce the manufacture cost.

For more clearly and easily understanding above content of the present invention, the following text will take a preferred embodiment of the present invention with reference to the accompanying drawings for detail description as follows.

DETAILED DESCRIPTION OF THE PREFERRED EMBODIMENTS

The following description of every embodiment with reference to the accompanying drawings is used to exemplify a specific embodiment, which may be carried out in the present invention.

Figure 1A:
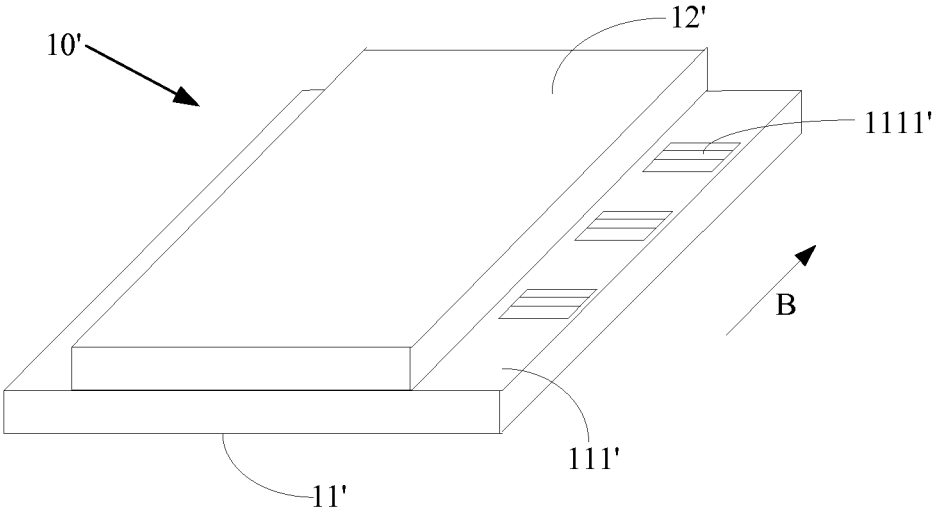
FIG. 1A is a structure schematic view of a liquid crystal panel.
Figure 1B:
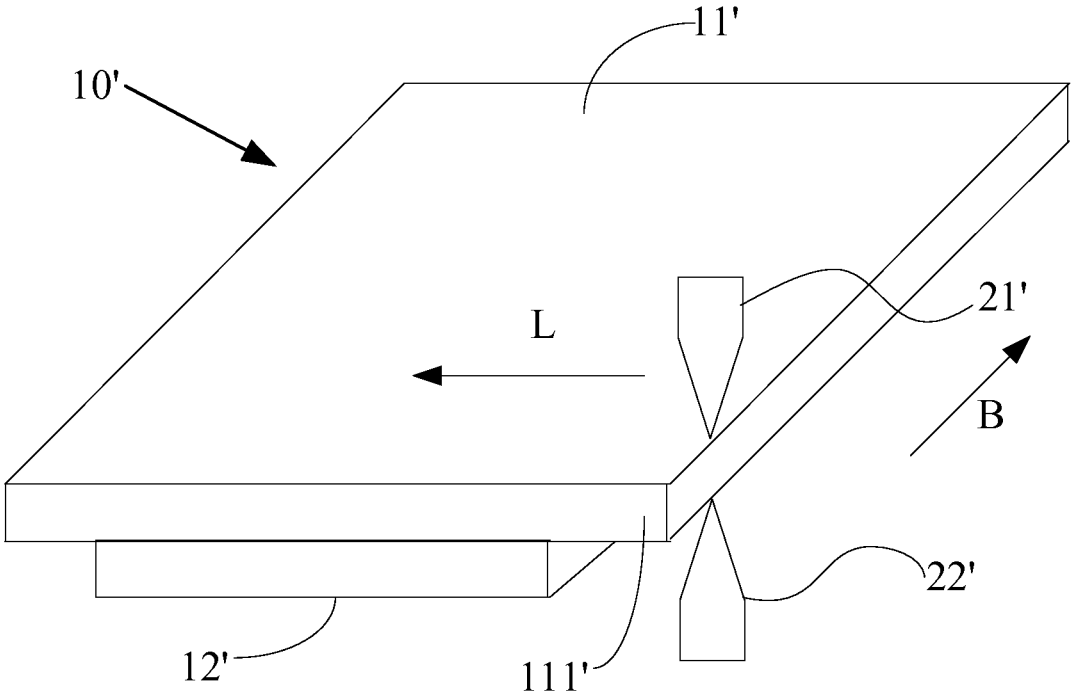
FIGS. 1B and 1C are schematic views of cutting the liquid crystal panel in the prior art.
Figure 1C:
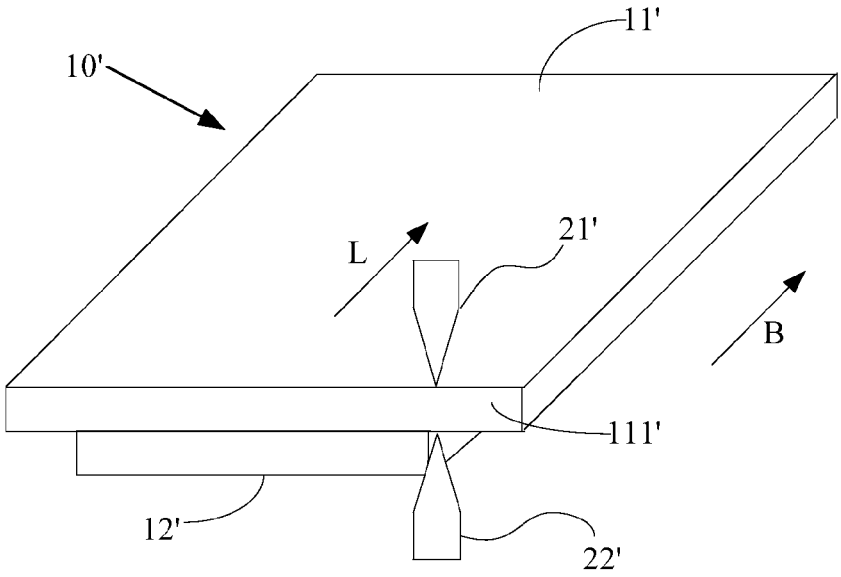
Figure 2:
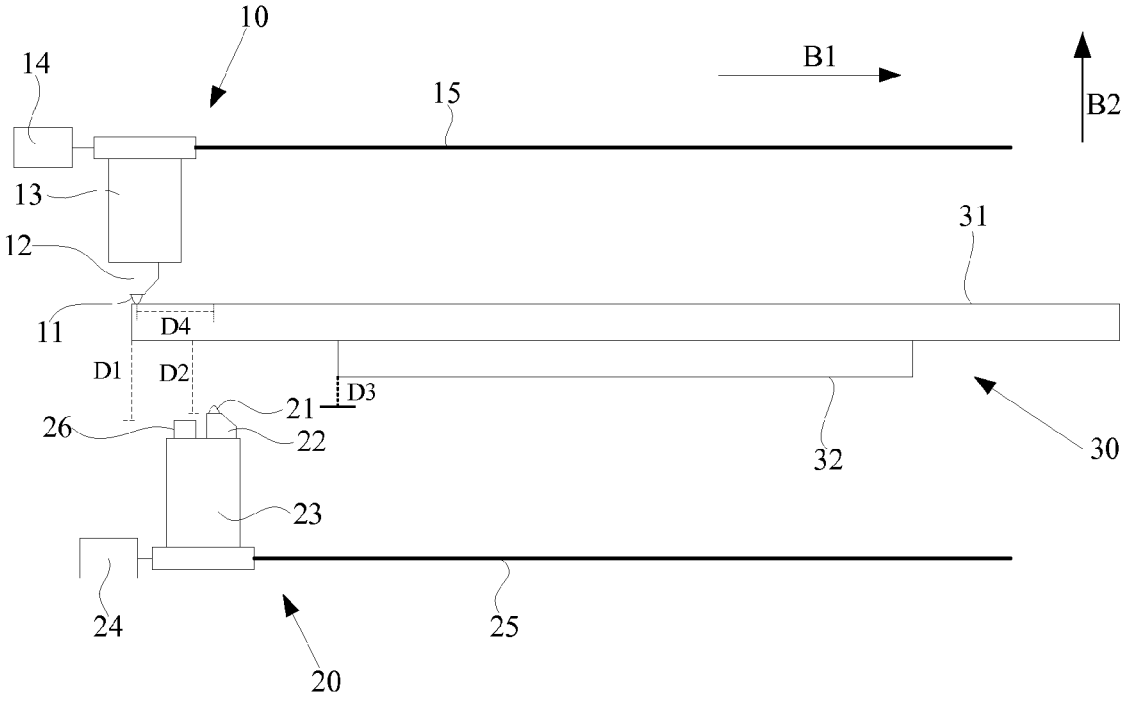
FIG. 2 is a schematic view of the position relationship between a preferred embodiment of a cutting device of a liquid crystal panel of the present invention and the liquid crystal panel.

Please refer to FIG. 2, which shows a schematic view of the position relationship between a preferred embodiment of a cutting device of a liquid crystal panel of the present invention and the liquid crystal panel, the cutting device of the liquid crystal panel comprises a first cutting portion 10 and a second cutting portion 20.

The first cutting portion 10 comprises a first cutter head 11, a first bracket 12, a first base 13, a first motor 14 and a first screw rod 15. The first cutter head 11 is disposed on the first bracket 12. The first bracket 12 is disposed on the first base 13. The first motor 14 is connected to the first base 13. The first base 13 is slidably connected to the first screw rod 15. The first motor 14 is used to drive the first base 13 to slide along the first screw rod 15.

The second cutting portion 20 comprises a second cutter head 21, a second bracket 22, a second base 23, a second motor 24, a second screw rod 25 and a nozzle 26. The second cutter head 21 is disposed on the second bracket 22. The second bracket 22 and the nozzle 26 are disposed on the second base 23. The second motor 24 is connected to the second base 23. The second base 23 is slidably connected to the second screw rod 25. The second motor 24 is used to drive the second base 23 to slide along the second screw rod 25.

Figure 3:
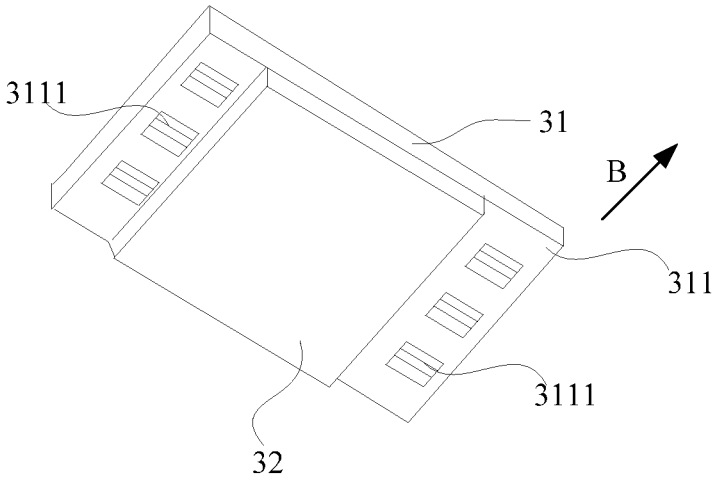
FIG. 3 is a structure schematic view of the liquid crystal panel cut by the cutting device of the liquid crystal panel of the present invention.

Please refer to FIG. 3, which is a perspective view of the liquid crystal panel 30 cut by the cutting device of the liquid crystal panel of the present invention, the liquid crystal panel 30 comprises a first substrate 31 and a second substrate 32. The first substrate 31 and the second substrate 32 are combined together. The first substrate 31 forms a terminal portion 311. The terminal portion 311 has multiple metal wires 3111. The metal wires 3111 are arranged along a direction B.

Please also refer to FIGS. 2 and 3, a direction B1 is parallel to the liquid crystal panel 30. A direction B2 is perpendicular to the liquid crystal panel 30. The first cutting portion 10 is opposite to the second cutting portion 20. The first cutter head 11 and the second cutter head 21 are staggered along the direction B2 so that forming a distance D4 in the direction B1. The liquid crystal panel 30 is located between the first cutter head 11 and the second cutter head 21. The first cutter head 11 is located above the first substrate 31, and the second cutter head 21 is located under the second substrate 32. There forms a supporting distance D1 between the nozzle 26 and the first substrate 31 in the direction B2. There forms a distance D2 between the second bracket 22 and the first substrate 31 in the direction B2. There also forms a cutter-feeding distance D3 between the second cutter head 21 and the second substrate 32 in the direction B2.

Please again refer to FIG. 2, the nozzle 26 can eject gas along the direction B2 for supporting the first substrate 31 when the first cutter head 11 cuts the terminal portion 311 of the first substrate 31.

Figure 4:
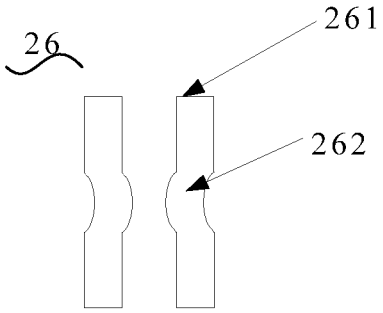
FIG. 4 is a structure schematic view of a preferred embodiment of a nozzle of the cutting device of the liquid crystal panel of the present invention.

Please also refer to FIGS. 2 and 4, FIG. 4 is a structure schematic view of a preferred embodiment of the nozzle 26 of the present invention. The nozzle 26 is a Laval tube. The nozzle 26 includes an exit opening 261 and a throat portion 262. The Laval tube may eject gas having enough pressure to support the first substrate 31. The nozzle 26 also includes a cavity structure for ejecting gas. Because it is prior art, no repeated here. Of course, in the specific implementation, the nozzle 26 also may be a support portion having other structure, such as a support pole capable of being automatic telescopic, which can support the first substrate 31 when the first cutter head 11 cuts the terminal portion 311 of the first substrate 31. Here is not to enumerate.

When the cutting device of the liquid crystal panel cuts the terminal portion 311 of the first substrate 31, and the second cutter head 21 does not cut the second substrate 32 yet, now the nozzle 26 ejects gas to support the first substrate 31 for avoiding the damage of the liquid crystal panel 30 due to the imbalanced force be applied to the terminal portion 311 of the first substrate 31.

Please continuously refer to FIG. 2, in the direction B1, the distance D2 between the second bracket 22 and the first substrate 31 is less than the supporting distance D1 between the nozzle 26 and the first substrate 31. Accordingly, when the second base 23 moves along the direction B1, it can avoid the contact of the nozzle 26 and the second substrate 32 so that further assuring the cutting quality.

In this embodiment, in order to avoid the cutting section of the liquid crystal panel 30 being too large due to the distance D4 between the first cutter head 11 and the second cutter head 21 in the direction B1 being too large, the distance D4 between the first cutter head 11 and the second cutter head 21 along the direction B1 should not be too large. Preferably, the distance D4 should be less than or equal to 3.5 mm.

The cutter-feeding distance D3 between the second cutter head 21 and the second substrate 32 along the direction B2 is greater than zero. When the second motor 24 drives the second base 23 to move along the direction B1 and controls the second cutter head 21 to move the cutter-feeding distance D3 along the direction B2, the second cutter head 21 contacts the second substrate 32. The embodiment employs the cutter-feeding distance D3 spaced between the second cutter head 21 and the second substrate 32 to assure that the second cutter head 21 can not collide with the edge of the second substrate 32 before cutting the second substrate 32. In the specific implementation, a moving speed (namely a cutter-feeding speed) of the second cutter head 21 in the direction B2 may be adjusted according to a moving speed of the second cutter head 21 in the direction B1 and the cutter-feeding distance D3, and no repeated here.

Figure 5:
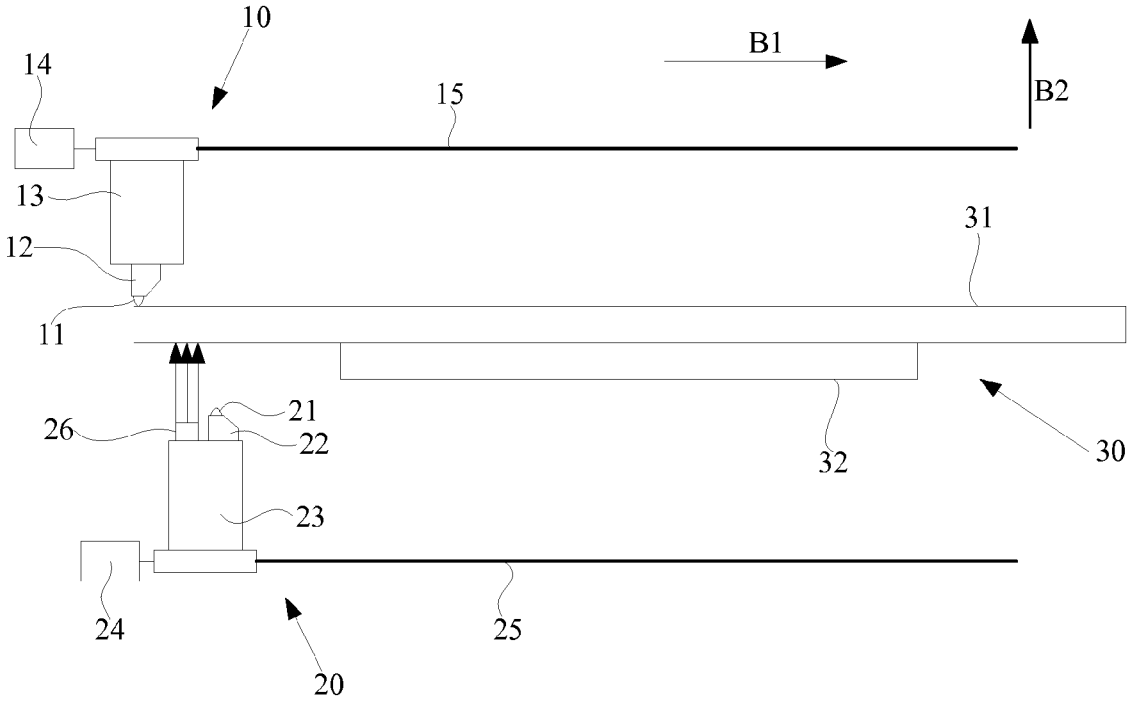
FIG. 5 is a schematic view of a starting position of the cutting device of the liquid crystal panel of the present invention when cutting the liquid crystal panel.
Figure 6:
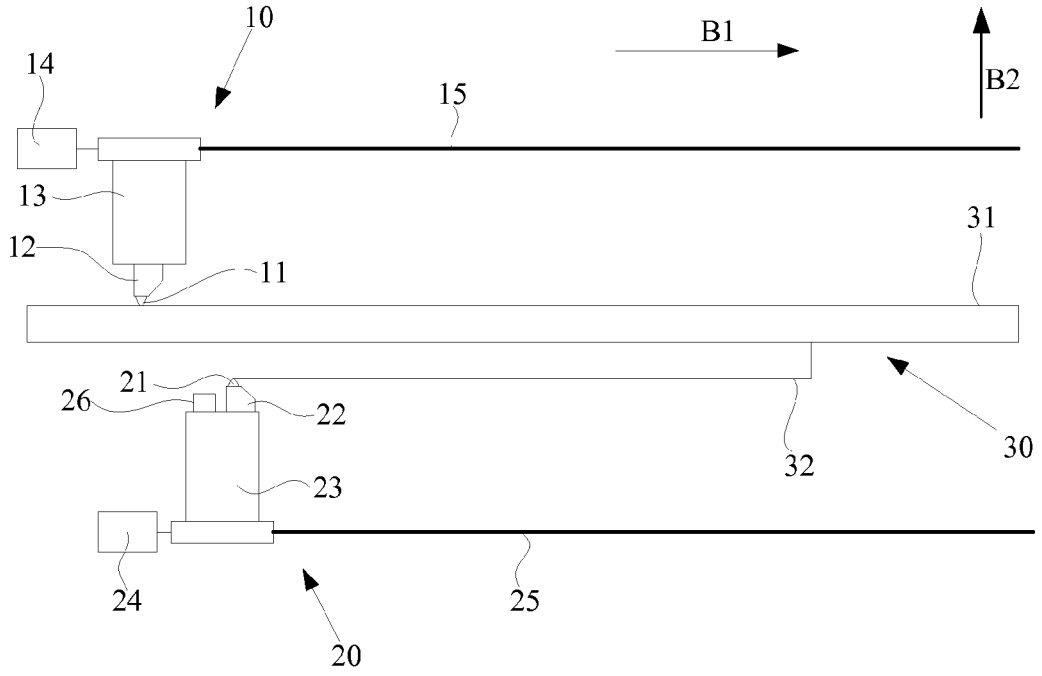
FIG. 6 is a schematic view of a cutting position of the cutting device of the liquid crystal panel of the present invention when cutting the liquid crystal panel.

The following text will specifically describe the process of cutting the liquid crystal panel by the cutting device of the liquid crystal panel of the present invention with reference to FIGS. 2, 5 and 6.

Please refer to FIGS. 2 and 5, the cutting device of the liquid crystal panel cuts the liquid crystal panel 30 along the direction B1. The first motor 14 drives the first base 13 to slide along the first screw rod 15. The first cutter head 11 contacts the first substrate 31 and starts to cut the terminal portion 311 of the first substrate 31. At the same time, the nozzle 26 ejects gas to support the first substrate 31. The second motor 24 drives the second base 23 to slide along the second screw rod 25 and simultaneously controls the second cutter head 21 to move toward the second substrate 32 along the direction B2. After controlling the second cutter head 21 to move the cutter-feeding distance D3 along the direction B2, the second cutter head 21 contacts the second substrate 32.

Please refer to FIGS. 2 and 6, the second cutter head 21 contacts the second substrate 32 and starts to cut the second substrate 32, and the nozzle 26 stops ejecting gas. Because the second cutter head 21 can simultaneously provide a supporting force for the liquid crystal panel 30 when cutting the second substrate 32, the pressure produced on the liquid crystal panel 30 when the first cutter head 11 cutting the first substrate 31 can be balanced. Accordingly, the tilt phenomenon does not occur on the liquid crystal panel 30 and the cutting quality can be assured.

The present invention employs the nozzle 26 disposed on the second cutting portion 20. When the first cutting portion 10 cuts the terminal portion 311 of the first substrate 31, the nozzle 26 ejects gas to support the first substrate 31. Obviously, regardless of the flow direction of the liquid crystal panel 30 having the terminal portion 311, the present invention still can efficiently cut the liquid crystal panel 30, eliminate the adverse effect resulted by the terminal portion 311, assure the cutting quality, and improve the cutting efficiency. And there is no need to add a pre-cutting portion, which reduces the manufacture cost.

Figure 7:
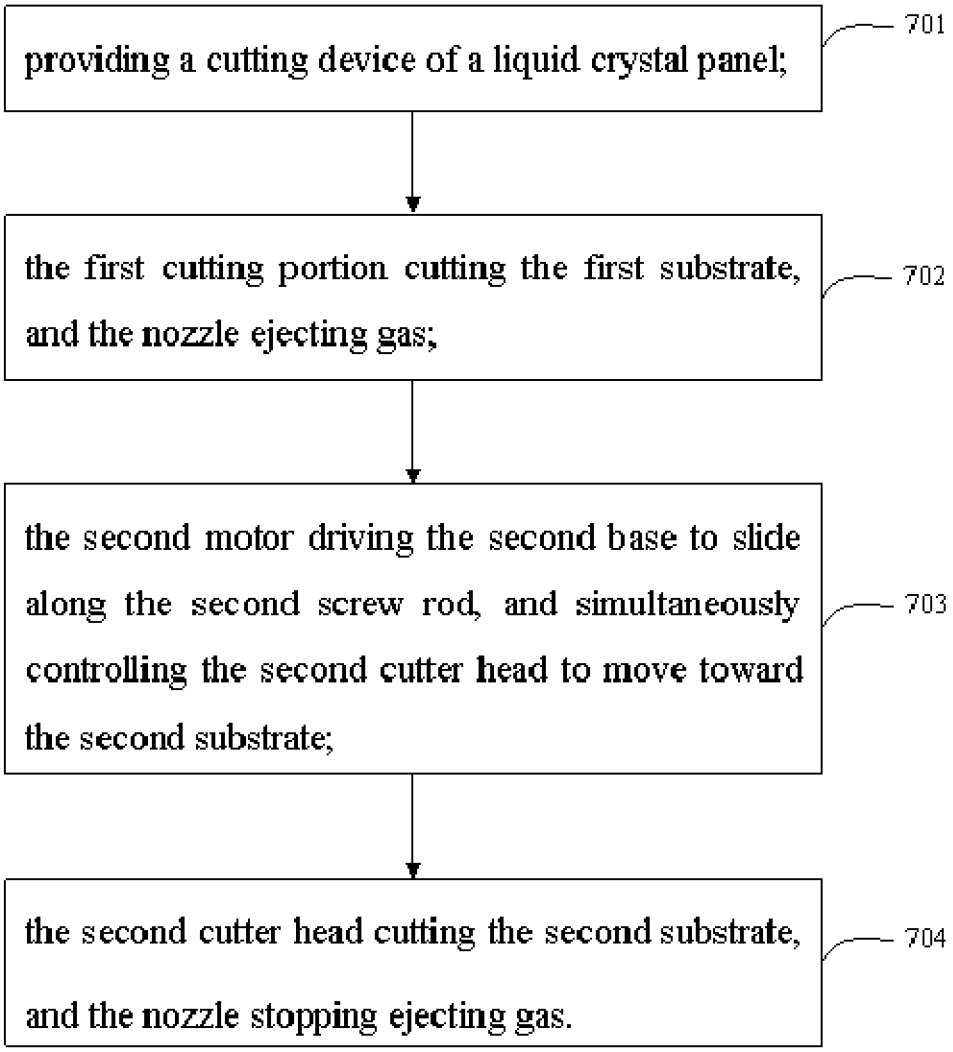
FIG. 7 is a flow chart of a preferred embodiment of a cutting method of the liquid crystal panel of the present invention.

Please refer to FIG. 7, FIG. 7 is a flow chart of a preferred embodiment of a cutting method of the liquid crystal panel of the present invention. The cutting method of the liquid crystal panel comprises the following steps:

A step S701: providing a cutting device of a liquid crystal panel, the detail structure of the cutting device of the liquid crystal panel may refer to the description of FIGS. 2 to 6, so no repeated here.

A step S702: the first cutting portion 21 cutting the first substrate 31, and the nozzle 26 ejecting gas.

In this step, the first motor 14 drives the first base 13 to slide along the first screw rod 15, the first cutter head 11 contacts the first substrate 31 and starts to cut the first substrate 31. Wherein, a start position of cutting the liquid crystal panel 30 is one end of the liquid crystal panel 30 where the terminal portion 311 is located, and the cutting direction of the first cutter head 11 is perpendicular to the arrangement direction B of the metal wires 3111.

The nozzle 26 ejects gas for supporting the first substrate 31. Because the gas ejected by the nozzle 26 can produce a supporting force. The supporting force supports the first substrate 31 to balance the pressure produced by the first cutter head 11 on the first substrate 31. In the specific implementation, the nozzle 26 may be a support portion having other structure, such as a support pole capable of being automatic telescopic, which can support the first substrate 31 when the first cutter head 11 cuts the terminal portion 311 of the first substrate 31. Here is not to enumerate.

A step S703: the second motor 24 driving the second base 23 to slide along the second screw rod 25 and simultaneously controlling the second cutter head 22 to move toward the second substrate 32 along the direction B2, and the second cutter head 22 contacting the second substrate 32 after the second cutter head 22 moving the cutter-feeding distance D3 along the direction B2.

A step S704: the second cutter head 21 cutting the second substrate 32, and the nozzle 26 stopping ejecting gas.

The present invention disposes the nozzle 26 on the second cutting portion 20. When the first cutting portion 10 cuts the terminal portion 311 of the first substrate 31, the nozzle 26 can eject gas to support the first substrate 31. Obviously, regardless of the flow direction of the liquid crystal panel 30 having the terminal portion 311, the present invention still can efficiently cut the liquid crystal panel 30, eliminate the adverse effect resulted by the terminal portion 311, assure the cutting quality, and improve the cutting efficiency. And there is no need to add a pre-cutting portion, which reduces the manufacture cost.

In conclusion, although the present invention has been disclosed by above preferred embodiments, above preferred embodiments are not used to limit the present invention. One of ordinary skills in the art also can make all sorts of improvements and amendments within the principles of the present invention. Therefore, the protection scope of the present invention should be based on the scope defined by the appended claims.

What is claimed is:

1. A cutting method of a liquid crystal panel, the liquid crystal panel comprising a first substrate and a second substrate assembled together, characterized in that: the cutting method of the liquid crystal panel comprises the following steps:

providing a cutting device of the liquid crystal panel, the cutting device of the liquid crystal panel comprising a first cutting portion and a second cutting portion, the second cutting portion including a support portion;

controlling the first cutting portion to contact the first substrate and start to cut the first substrate, and simultaneously employing the support portion to support the first substrate;

controlling the second cutting portion to contact the second substrate and start to cut the second substrate, and stopping the support portion supporting the first substrate.

2. The cutting method of the liquid crystal panel as claimed in claim 1, characterized in that: before controlling the second cutting portion to contact the second substrate, the method further comprises the following step:

controlling the second cutting portion to move a feeding distance along a direction perpendicular to the liquid crystal panel for contacting the second substrate.

3. The cutting method of the liquid crystal panel as claimed in claim 1, characterized in that: the support portion is a nozzle, the step of employing the support portion to support the first substrate specifically includes: employing the nozzle to eject gas for supporting the first substrate.

4. A cutting device of a liquid crystal panel, the liquid crystal panel comprising a first substrate and a second substrate assembled together, the cutting device of the liquid crystal panel comprising a first cutting portion and a second cutting portion, the first cutting portion including a first cutter head for cutting the first substrate, the second cutting portion including a second cutter head for cutting the second substrate, characterized in that:

the first cutter head and the second cutter head being staggered in a direction perpendicular to the liquid crystal panel, and the first cutter head and the second cutter head being spaced a distance in a direction parallel to the liquid crystal panel; and the second cutting portion further including a support portion, the support portion being a nozzle, the nozzle being used to eject gas for supporting the first substrate when the first cutting portion cuts the first substrate, and the second cutting portion being deactivated with regard to the second substrate when the nozzle is activated.

5. The cutting device of the liquid crystal panel as claimed in claim 4, characterized in that: the second cutter head and the second substrate are spaced a feeding distance in the direction perpendicular to the liquid crystal panel.

6. The cutting device of the liquid crystal panel as claimed in claim 4, characterized in that: the second cutting portion further includes a second base and a second bracket, both the second bracket and the support portion are disposed on the second base, and a distance between the second bracket and the first substrate is less than a distance between the support portion and the first substrate.

7. The cutting device of the liquid crystal panel as claimed in claim 6, characterized in that:

the first cutting portion includes the first cutter head, a first bracket, a first base, a first motor and a first screw rod, the first cutter head is disposed on the first bracket, the first bracket is disposed on the first base, the first motor is connected to the first base, the first base is slidably connected to the first screw rod, and the first motor is used to drive the first base to slide along the first screw rod;

the second cutting portion includes the second cutter head, a second bracket, a second base, a second motor, a second screw rod and the support portion, the second motor is connected to the second base, the second base is slidably connected to the second screw rod, and the second motor is used to drive the second base to slide along the second screw rod.

8. The cutting device of the liquid crystal panel as claimed in claim 4, characterized in that: the distance between the first cutter head and the second cutter head along the direction parallel to the liquid crystal panel is less than or equal to 3.5 millimeter.

9. A cutting device of a liquid crystal panel, the liquid crystal panel comprising a first substrate and a second substrate assembled together, the cutting device of the liquid crystal panel comprising a first cutting portion for cutting the first substrate and a second cutting portion for cutting the second substrate, characterized in that:

the first cutting portion including a first cutter head for cutting the first substrate, the second cutting portion including a second cutter head for cutting the second substrate, the first cutter head and the second cutter head being staggered in a direction perpendicular to the liquid crystal panel, and the first cutter head and the second cutter head being spaced a distance along a direction parallel to the liquid crystal panel;

the second cutting portion including a support portion, and the support portion being used to support the first substrate when the first cutting portion cuts the first substrate and the second cutter head of the second cutting portion is deactivated with regard to the second substrate; and the second cutting portion further including a second base and a second bracket, both the second bracket and the support portion being disposed on the second base, and a distance between the second bracket and the first substrate being less than a distance between the support portion and the first substrate.

10. The cutting device of the liquid crystal panel as claimed in claim 9, characterized in that: the second cutter head and the second substrate are spaced a feeding distance in the direction perpendicular to the liquid crystal panel.

11. The cutting device of the liquid crystal panel as claimed in claim 9, characterized in that:

the first cutting portion includes the first cutter head, a first bracket, a first base, a first motor and a first screw rod, the first cutter head is disposed on the first bracket, the first bracket is disposed on the first base, the first motor is connected to the first base, the first base is slidably connected to the first screw rod, and the first motor is used to drive the first base to slide along the first screw rod;

the second cutting portion includes the second cutter head, a second bracket, a second base, a second motor, a second screw rod and the support portion, the second motor is connected to the second base, the second base is slidably connected to the second screw rod, and the second motor is used to drive the second base to slide along the second screw rod.

12. The cutting device of the liquid crystal panel as claimed in claim 9, characterized in that: the distance between the first cutter head and the second cutter head along the direction parallel to the liquid crystal panel is less than or equal to 3.5 millimeter.

13. The cutting device of the liquid crystal panel as claimed in claim 9, characterized in that: the support portion is a nozzle, and the nozzle is used to eject gas for supporting the first substrate.

* * * * *